US007211750B2

(12) United States Patent
Fillppenko et al.

(10) Patent No.: US 7,211,750 B2
(45) Date of Patent: May 1, 2007

(54) SWITCHING MECHANISM WITH SHOCK ABSORBER

(75) Inventors: Alexander S. Fillppenko, Cary, NC (US); Gary Pollard, Wendell, NC (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 11/021,180

(22) Filed: Dec. 22, 2004

(65) Prior Publication Data

US 2006/0131144 A1 Jun. 22, 2006

(51) Int. Cl.
*H01H 1/20* (2006.01)
*H01H 9/20* (2006.01)
*H01H 9/26* (2006.01)

(52) U.S. Cl. ..... 200/50.32; 200/50.33; 200/18

(58) Field of Classification Search ..... 200/50.32, 200/50.33, 1 R, 18, 401; 361/605, 609, 615; 335/68, 69; 336/69
See application file for complete search history.

(56) References Cited

U.S. PATENT DOCUMENTS 4,157,461 A 6/1979 Wiktor
4,189,649 A 2/1980 Przywozny et al.
4,398,097 A 8/1983 Schell et al.
4,423,336 A 12/1983 Iverson et al.
4,760,278 A * 7/1988 Thomson ..... 307/64
4,939,491 A * 7/1990 Nissly et al. ..... 335/18
4,951,020 A * 8/1990 Changle et al. ..... 355/167
4,996,507 A * 2/1991 McKee et al. ..... 335/195
5,025,171 A * 6/1991 Fanta et al. ..... 307/150
5,057,806 A * 10/1991 McKee et al. ..... 335/9
5,151,567 A * 9/1992 Thuries ..... 218/84
5,200,724 A * 4/1993 Gula et al. ..... 335/166
5,397,868 A 3/1995 Smith et al.
5,436,415 A * 7/1995 Smith et al. ..... 200/50.35
5,475,190 A 12/1995 Smith et al.
5,550,707 A 8/1996 Iversen
6,100,604 A * 8/2000 Morroni et al. ..... 307/64
6,110,604 A 8/2000 Rickerby
6,172,432 B1 1/2001 Schnackenberg et al.
6,181,028 B1 1/2001 Kern et al.
6,541,718 B2 4/2003 Burkholder et al.
6,563,233 B1 5/2003 Hinks
6,570,269 B2 5/2003 McMillan et al.
6,686,547 B2 2/2004 Kern et al.
7,009,130 B2 * 3/2006 Hashimoto et al. ..... 200/400

* cited by examiner

*Primary Examiner*—Elvin Enad
*Assistant Examiner*—Lheiren Mae A. Anglo

(57) ABSTRACT

A switching mechanism provides sequential switching of first and second circuit breakers to enable switching between a primary power supply and a backup power supply. The switching mechanism comprises an actuating mechanism to sequentially actuate a pair of circuit breakers. The actuator mechanism including a shock absorber to absorb energy due to switching of one of the first and second circuit breakers.

13 Claims, 13 Drawing Sheets

SWITCHING MECHANISM WITH SHOCK ABSORBER

BACKGROUND OF THE INVENTION

The present invention relates to transfer switches for switching between alternate power sources, such as commercial power supply lines and a local generator.

Many residents now have a stand-by power supply such as a gas-powered generator for use in homes and other buildings during power outages. Power from the local generator can be supplied to a main distribution panel or sub-panel through a transfer switch when a power outage occurs. The transfer switch disconnects the home or building from the commercial power supply lines and connects the home or building to the local generator.

The installation of a transfer switch typically requires the replacement of the main distribution panel in the home or building with a larger distribution panel to accommodate the transfer switch, or the installation of a separate sub-panel containing the transfer switch and additional circuit breakers. The cost of parts and labor to install a transfer switch can be prohibitively expensive to many persons. Another potential problem that can occur during installation is lack of space to accommodate an additional distribution panel if one is required.

A transfer switch that can be accommodated in an existing distribution panel of a home or building would eliminate much of the cost of installing a transfer switch in an existing home or building, and would not be precluded by space constraints.

SUMMARY OF THE INVENTION

The present invention provides a switching mechanism that can be installed in an existing electrical distribution panel of a home or building to actuate circuit breakers in a predetermined sequence. The switching mechanism in combination with the circuit breakers functions as a transfer switch. The device is simple in construction and easily installed into an existing distribution panel.

The switching mechanism comprises an actuating mechanism operatively engaged with the main circuit breaker and backup circuit breaker. The actuating mechanism includes a drive motor to drive the actuating mechanism. A shock absorber protects the drive motor from damage by absorbing shock caused by operation of the circuit breaker. A shock absorber may be used for only the main circuit breaker, or for both circuit breakers.

DETAILED DESCRIPTION OF THE INVENTION

Figure 1:
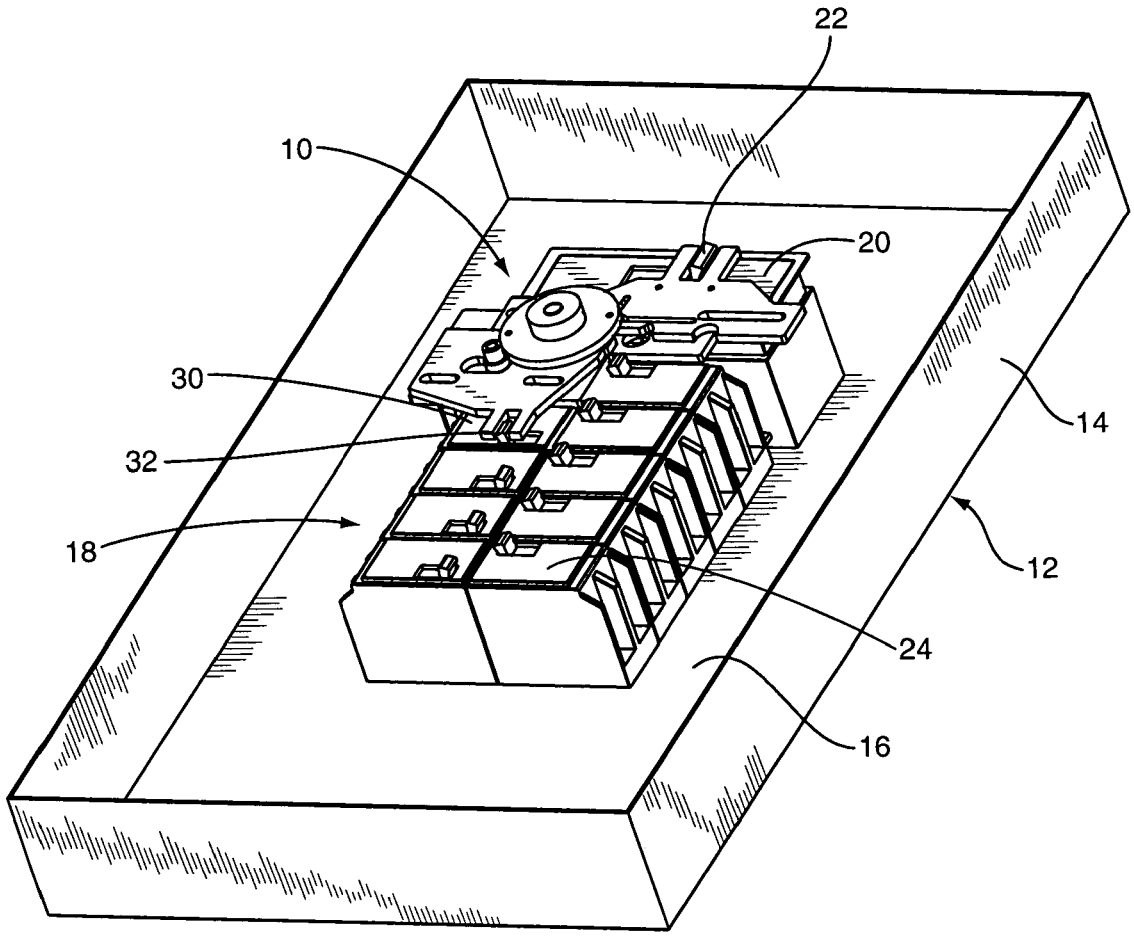
FIG. 1 is a perspective view of a switching mechanism according to the present invention installed in an electrical distribution panel.
Figure 2:
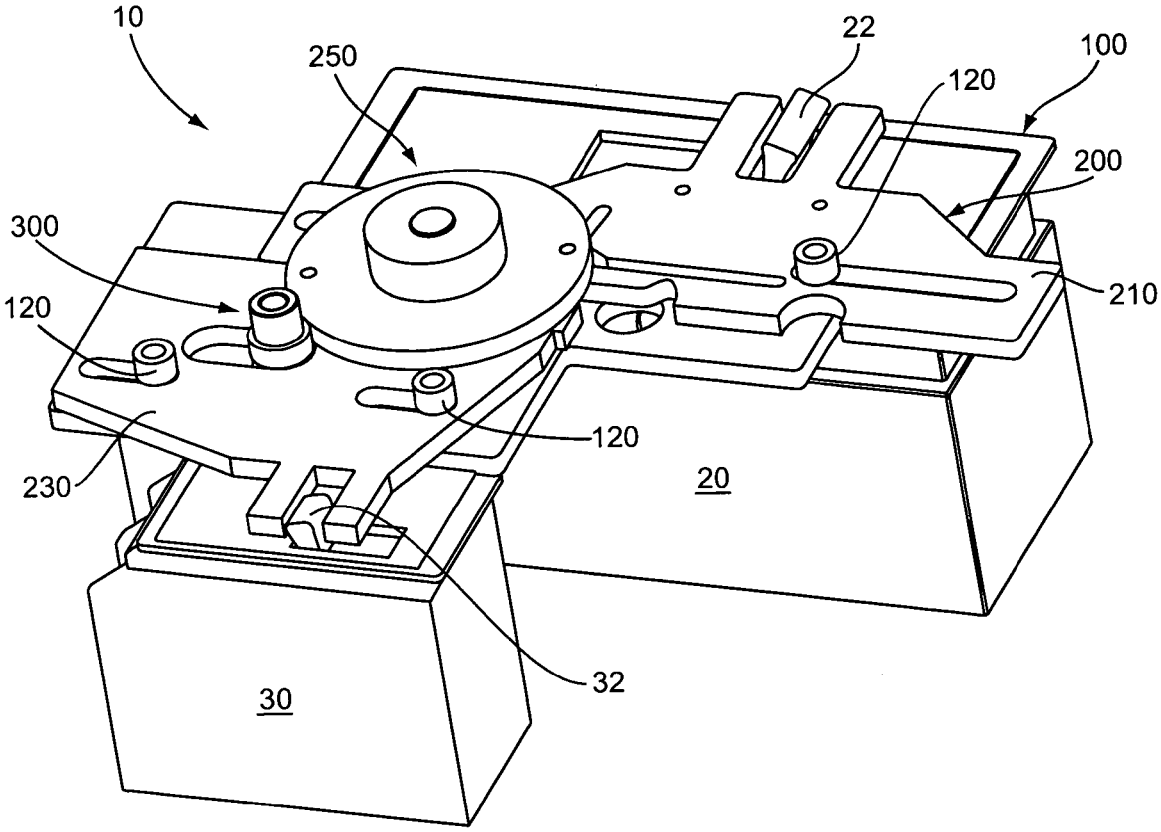
FIG. 2 is a close-up perspective view of the switching mechanism and two circuit breakers.
Figure 3:
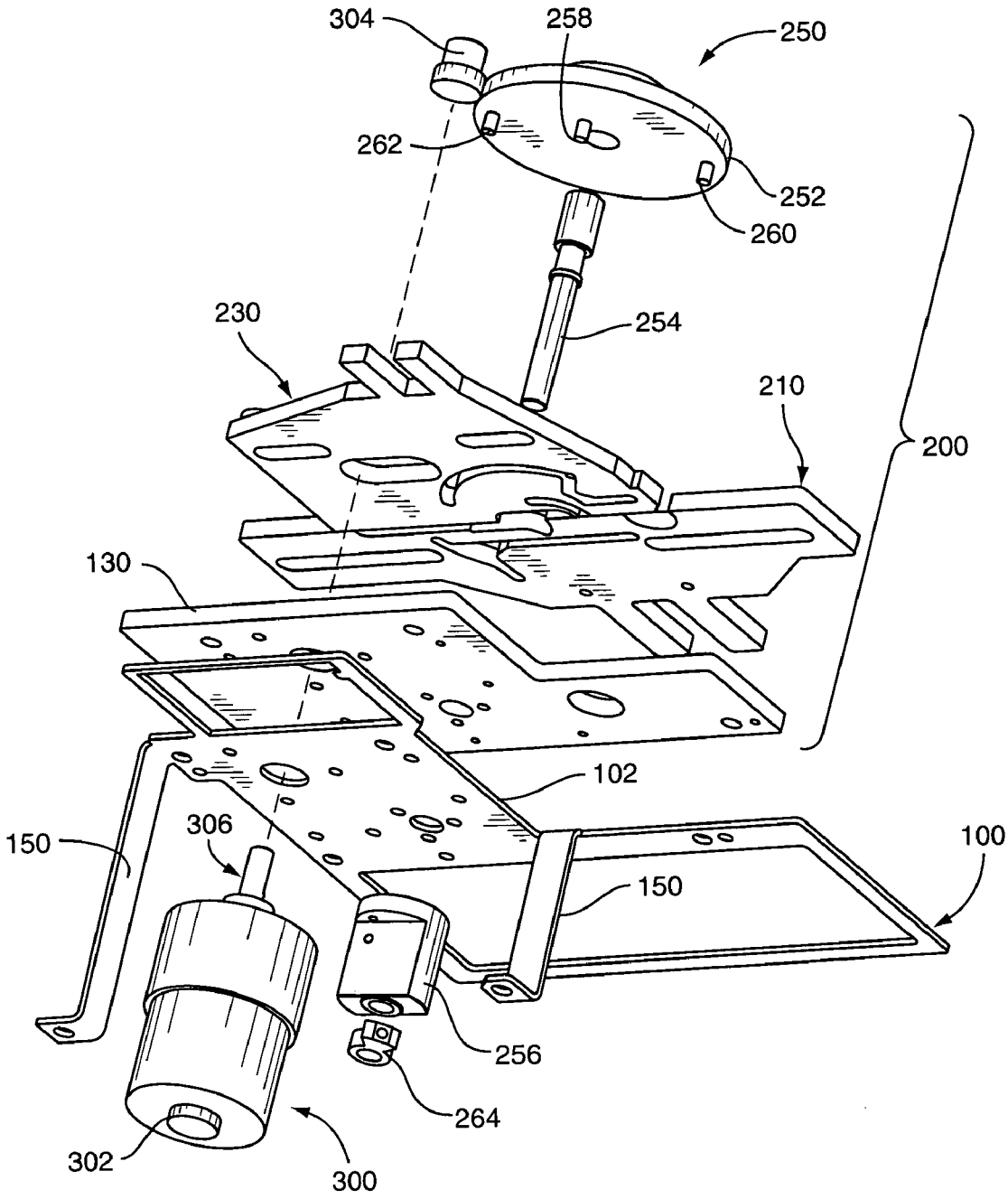
FIG. 3 is an exploded perspective view of the switching mechanism.

FIGS. 1–3 illustrate a switching mechanism indicated generally at 10 installed in an electrical distribution panel 12. The distribution panel 12 comprises a cabinet 14, a back plane 16 with interior parts (not shown), and a plurality of circuit breakers 18 including a main circuit breaker 20, a backup circuit breaker 30 and a number of branch circuit breakers 24. The main circuit breaker 20 connects the electrical distribution panel 12 to commercial power supply lines. The backup circuit breaker 30 connects the electrical distribution panel 12 to a local generator. The branch circuit breakers 24 connect the various loads in the residence or building to the electrical distribution panel 12. The switching mechanism 10 in combination with the main circuit breaker 20 and backup circuit breaker 22 function as a transfer switch.

The switching mechanism 10 comprises three main assemblies—a support assembly 100, an actuator assembly 200, and a drive assembly 300. The support assembly 100 secures the switching mechanism 10 to the electrical distribution panel and provides support for the actuator assembly 200 and the drive assembly 300. The actuator assembly 200 operates the main circuit breaker 20 and backup circuit breaker 30 such that power to the branch circuit breakers 24 can be switched between the commercial power supply and the backup power supply. The drive assembly 300 includes a drive motor 302 to drive the actuator assembly 200.

Figure 4:
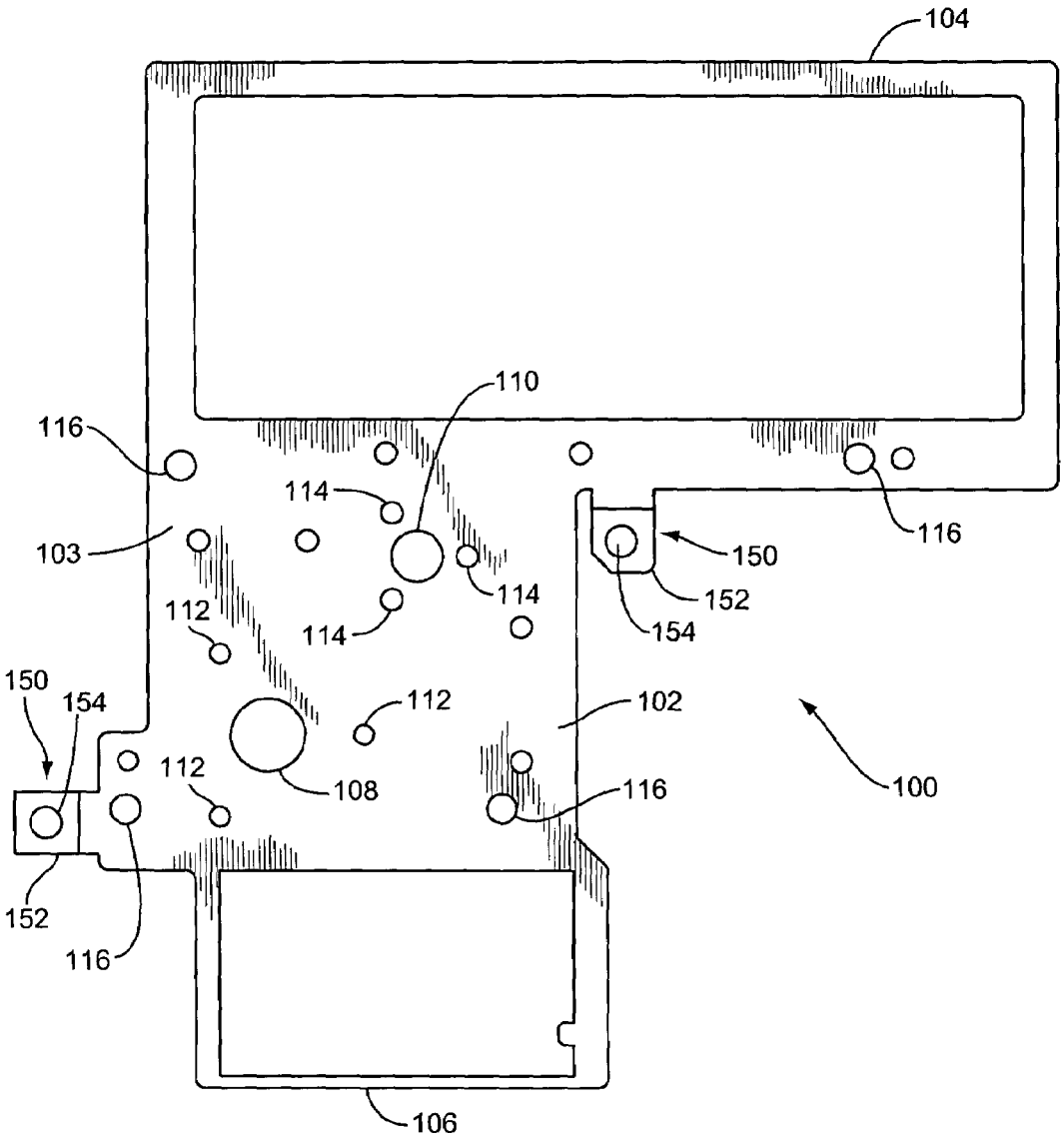
FIG. 4 is a top view of a support frame for the switching mechanism.
Figure 5:
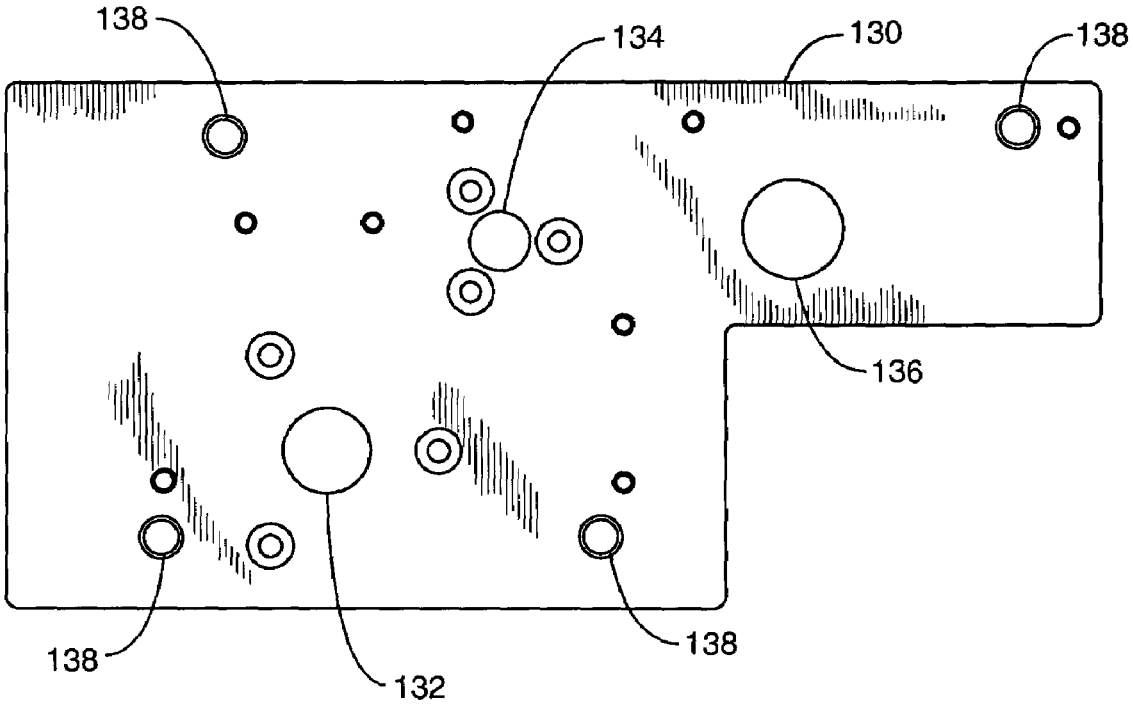
FIG. 5 is a top view of a support bracket for the switching mechanism.

FIGS. 3–5 illustrate details of the support assembly 100. The support assembly 100 comprises a generally-planar support bracket 102 and a support plate 130. The support bracket 102 secures the switching assembly to the electrical distribution panel 12. The support bracket 102 includes a top plate 103 and support legs 150. The support legs 150 extend generally perpendicularly from the top plate 103. The outer end of each support leg 150 is bent at a 90° angle to form a support foot 152. The support foot 152 includes a screw hole 154 to accept a mounting screw (not shown) for securing the support bracket 102 to the distribution panel 12. The support plate 130 mounts on top of the support bracket 102 to provide a stable platform for the actuator assembly 200. When mounted in a distribution panel 12, the support plate 130 is oriented generally parallel to the back plane 16 of the distribution panel 12. The support legs 150 provide the proper spacing from the back plane 16

The support bracket 102, in addition to providing support for the switching assembly, also braces the main circuit breaker 20 and backup circuit breaker 30. In the exemplary embodiment shown in the drawings, the support bracket 102 includes a large frame 104 that extends around the housing of the main circuit breaker 20, and a smaller frame 106 that extends around the housing of the backup circuit breaker 30. Frames 104 and 106 prevent the circuit breakers 20 and 30 from twisting or otherwise moving during operation. Additionally, frame 106 serves as a hold-down device to hold down the backup circuit breaker 30.

The top plate 103 of the support bracket 102 includes clearance holes 108 and 110 for a motor shaft 306 and actuator shaft 254, respectively. Threaded screw holes 112 for mounting the drive motor 302 surround clearance hole 108. Similarly, threaded screw holes 114 for mounting an actuator shaft bearing 256 surround clearance hole 110. Support bracket 102 further includes guide screw holes 116 to accept guide screws 120. As will be explained in greater detail below, the guide screws 120 constrain the movement of the actuator assembly 200.

FIG. 5 illustrates the support plate 130. The support plate 130 comprises a steel plate that provides a platform for the actuator assembly 200. The support plate mounts on top of the support bracket 102 and can be secured by screws or any other suitable fastening means. The top surface of the support plate 130 is flat. Clearance holes 132 and 134 provide openings for the motor drive shaft 306 and actuator shaft 254 respectively. An access opening 136 provides access to mounting screws used to secure the support bracket 102 to the distribution panel 12. Guide screw holes 138 align with the guide screw holes 116 in the support bracket 102.

Figure 6:
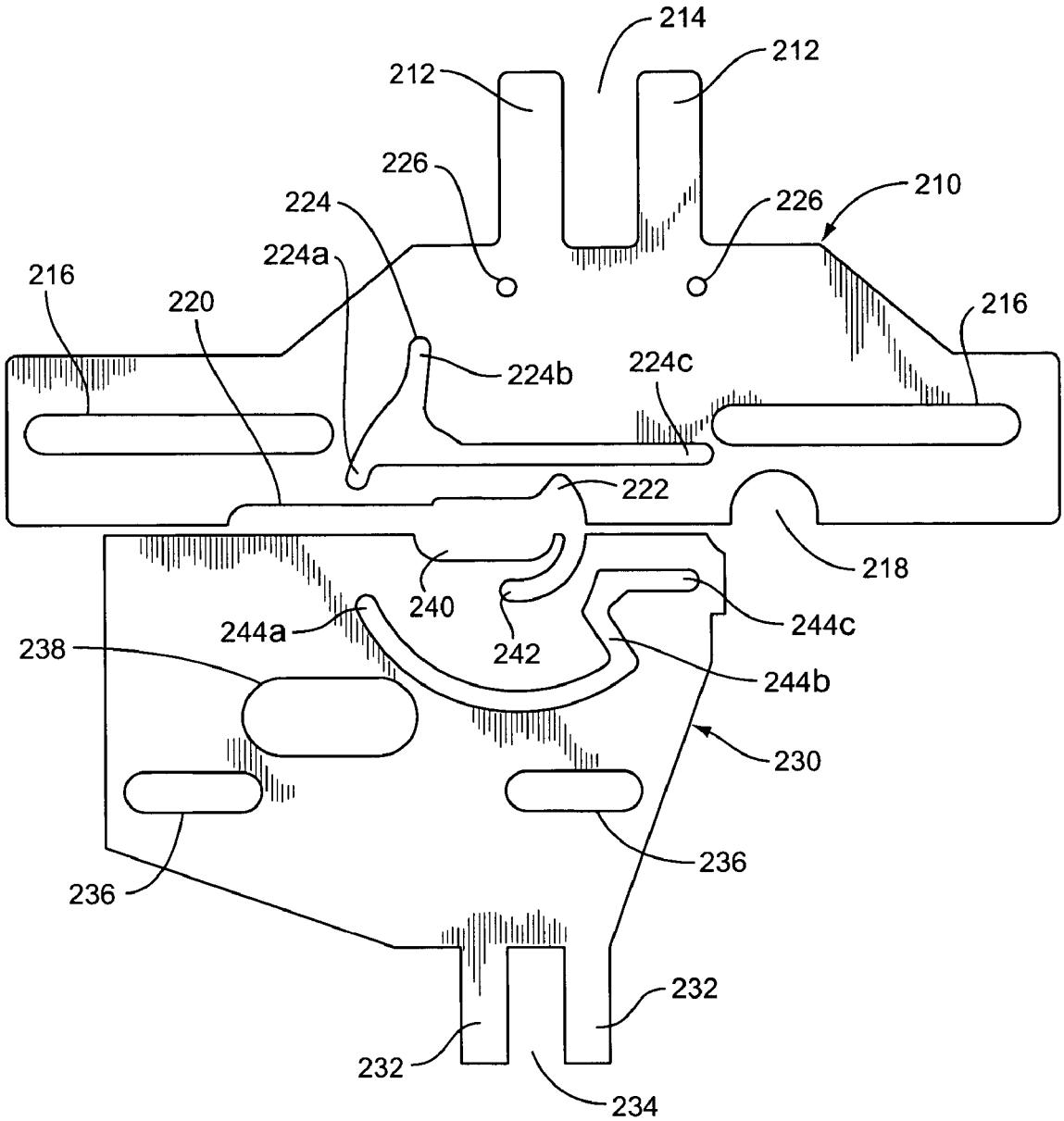
FIG. 6 is a top view of two actuator plates for the switching mechanism.

FIGS. 2 and 6 illustrate details of the actuator assembly 200. The actuator assembly 200 comprises a main actuator plate 210 operatively engaged with the main circuit breaker 20, a secondary actuator plate 230 operatively engaged with the backup circuit breaker 30, and a rotary actuator 250 to move the actuator plates 210 and 230 between on and off positions. The main actuator plate 210 includes a pair of spaced-apart fingers 212 defining a finger slot 214 to receive the toggle 22 of the main circuit breaker 20. Similarly, the secondary actuator plate 230 includes a pair of spaced-apart fingers 232 defining a finger slot 234 to receive the toggle 32 of the backup circuit breaker 30. As will be described in more detail below, the actuator plates 210 and 230 slide laterally in first and second directions on the surface of the support plate 130. The fingers 212 and 232 apply force to respective toggles 22 and 32 to switch on and off the circuit breakers 20 and 30.

Guide screws 120 extending through guide slots 216 and 236 in the actuator plates 210 and 230 respectively constrain and guide the movement of the actuator plates 210 and 230. The guide slots 216 and 236 extend parallel to the direction of movement of the actuator plates 210 and 230. Guide slots 216 and 236 are parallel to one another so that the actuator plates 210 and 230 move in parallel fashion. The guide screws 120 pass through the guide slots 216, 236 and thread into the guide screw holes 138 in the support plate and pass through the guide holes 116 in the support bracket 102.

Access opening 218 in actuator plate 210 provides access to mounting screws used to secure the support assembly 100 to the electrical distribution panel 12 when it is aligned with the access opening 136 in the support plate 130. Clearance opening 238 provides clearance for the motor shaft 306. Clearance opening 238 is elongated in the direction of movement to accommodate the travel of the actuator plate 230. Recesses 220 and 240 in the edges of actuator plates 210 and 230 respectively provide clearance for the actuator shaft 254.

A rotary actuator 250 shown best in FIGS. 2 and 3 moves the actuator plates 210 and 230 between on and off positions as the rotary actuator 250 rotates in first and second directions. The rotary actuator 250 comprises a rotor 252 mounted to one end of the actuator rotor shaft 254. The outer edge of the rotor 252 includes gear teeth, which are engaged by the drive gear 304 to rotate the actuator 250. Actuator shaft 254 extends downward between the actuator plates 210 and 230 and passes through openings 134 and 110 in the support plate 130 and support bracket 102 respectively. Actuator shaft 254 is journaled in a bearing 256 that mounts to the underside of the support frame 102 as shown in FIG. 3. A switch actuator 264 is attached to the lower end of the actuator shaft. As will be described in more detail below, switch actuator 264 actuates limit switches (not shown) that control operation of the actuator assembly 200.

Actuator pins 258, 260, 262 extend from the underside of the rotor 252. Actuator pin 258 moves within slots 222 and 242 in actuator plates 210 and 230, respectively. Actuator pin 260 functions as a drive member and moves within slot 224 in actuator plate 210. Actuator pin 262 functions as a drive member and moves within slot 244 in actuator plate 230. The geometry of the slots 224 and 244, along with the location of the actuator pins 260 and 262, provide sequential switching of the circuit breakers 20 and 30 so that both circuit breakers 20 and 30 are both switched off before one is switched on. This sequential actuation of the circuit breakers 20 and 30 ensures that the branch circuit breakers 24 are momentarily isolated from both power sources when switching from one power source to the other. The actuator assembly 200 allows a user to manually switch circuit breakers 20 or 30 to the off position when the other circuit breaker 20 or 30 is in the off position. Thus, the user can simultaneously turn both circuit breakers 20 and 30 off.

The actuator assembly 200 also functions as a mechanical interlock mechanism that prohibits a circuit breaker 20 or 30 from being turned on when the other circuit breaker 20 or 30 is on. Additionally, the actuator 250 is mechanically locked when one of the circuit breakers 20 and 30 is manually turned off or if a breaker is tripped. Thus, the user is required to manually turn on the circuit breaker 20 or 30, that was manually turned off, or to reset the tripped circuit breaker before automatic operation of the rotary actuator 250 can resume. These locking features prevent the user from inadvertently connecting the electrical distribution panel 12 to both the main and backup power sources at the same time, as well as preventing the drive motor 302 from operating the locked mechanism.

The drive assembly 300 comprises a drive motor 302, a drive gear 304 and motor controller 310. The drive motor 302 mounts to the underside of the support bracket 102 and is supported thereby. The motor shaft 306 passes through the clearance holes 108, 132 and 238 in the support bracket 102, support plate and actuator plate 230 respectively. The motor shaft 306 connects to a drive gear 304, which engages the periphery of the rotor 252. Alternatively, the drive motor 302 could directly drive the actuator 250. One advantage of the drive gear 304, however, is that through proper gearing a mechanical advantage is realized that allows use of a smaller and less expensive drive motor 302.

When installed in the distribution panel 12, the drive motor 302 occupies a space that would otherwise be used by branch circuit breakers 24. To install the switching mechanism 10, two branch circuit breakers 24 are removed to make space for the drive motor 302. Although two branch circuit breakers 24 are sacrificed in this arrangement, locating the drive motor 302 as shown herein allows the switch assembly 10 to be mounted within most existing distribution panels 12 currently in use in residential or light commercial construction. Therefore, there is no need to replace the existing distribution panel 12 or to add a sub-panel to install the switching mechanism 10. Furthermore, the two sacrificed branch circuit breakers can easily be replaced by using commercially available tandem circuit breakers.

Figure 15:
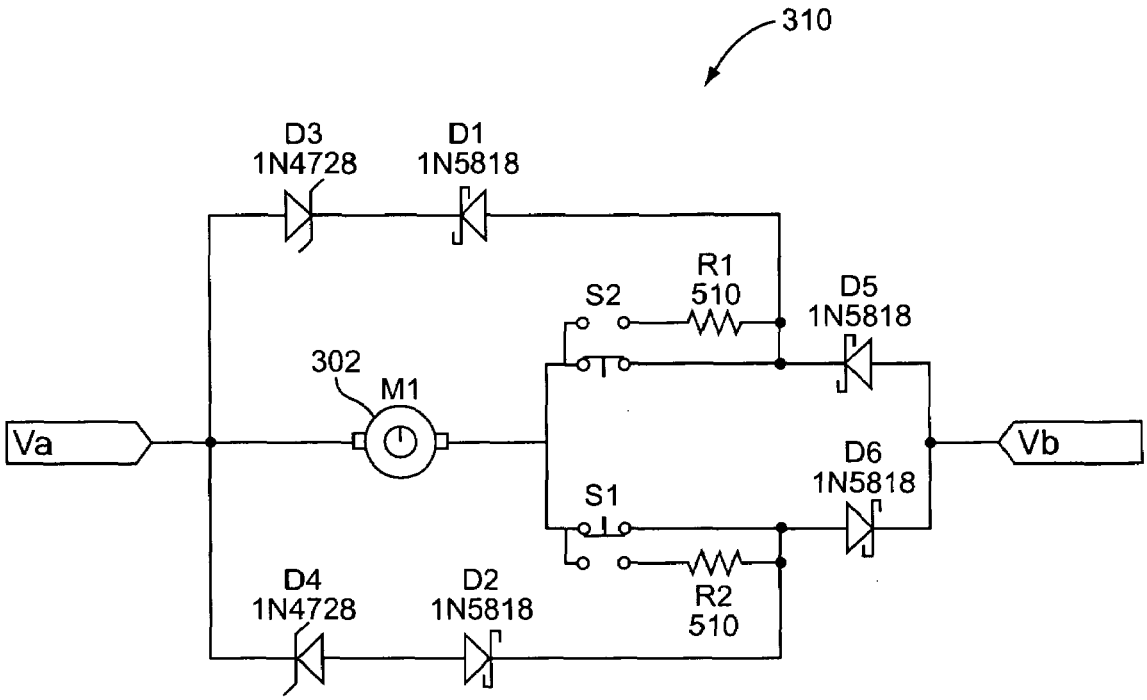
FIG. 15 is an electrical diagram of a motor controller.

FIG. 15 illustrates a motor controller 310 for controlling operation of the drive motor 302. The motor controller 310 is configured to reduce the speed of the drive motor 302 as the actuator plates 210 and 230 reach the limit of their travel. There are two branches in the motor controller circuit. The first branch includes diodes D1, D3, D5, resistor R1, and limit switch S2. The second branch includes diodes D2, D4, and D6, resistor R2, and limit switch S1. The motor controller 310 dynamically breaks but does not stop the drive motor 302 when one of the limit switches S1, S2 is tripped. Consequently, the speed of the drive motor 302 is reduced as the actuator plates 210, 230 approach their mechanical limits. The breaking is produced by shunting the drive motor 302 with a couple—schottky diodes/zener diode—with a voltage significantly lower than the rated motor voltage. Resistors R1 and R2 provide bias current to keep voltage on the zener diode so the drive motor 302 continues to operate at a low speed. For example, a 3.6 volt zener diode connected to a 24 volt rated motor quickly slows down to approximately 10% of its full speed. The second branch in the controller circuit allows the drive motor 302 to operate at full speed in the opposite direction if necessary. A current sensor (not shown) can sense the current in the controller circuit and shut off power to the drive motor 302 when the mechanical limits are reached.

Figure 7:
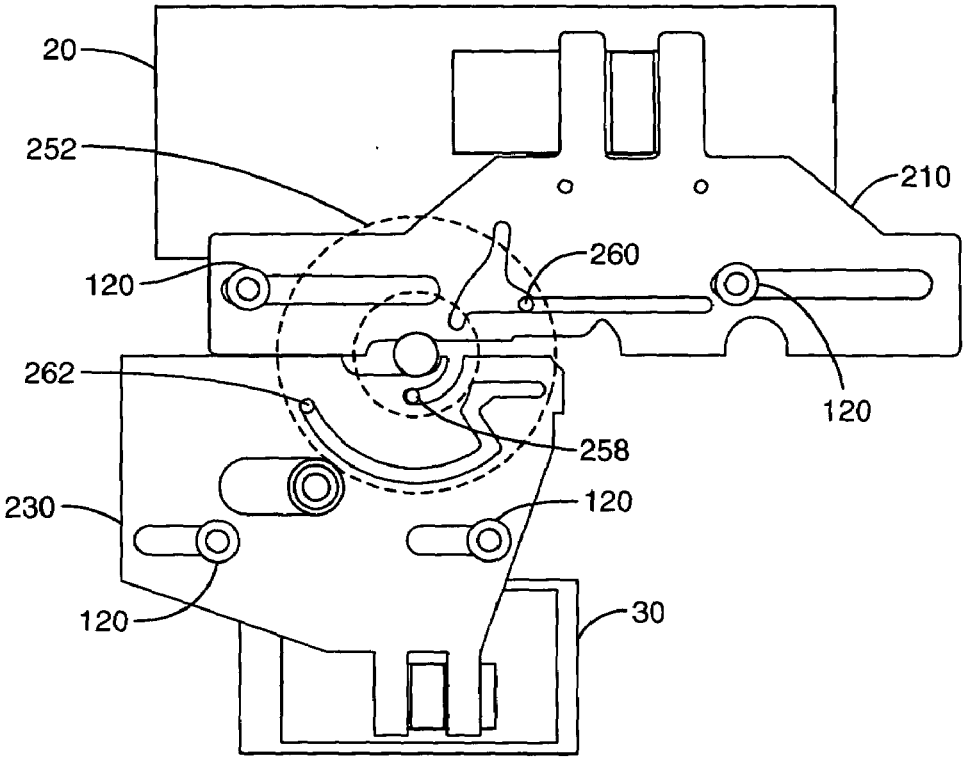
FIG. 7 is a top view of the switching mechanism at the beginning of a switching cycle showing the main circuit breaker in an on position and the backup circuit breaker in an off position.

FIGS. 7–14 illustrate the operation of the actuator assembly 200. FIG. 7 illustrates actuator plate 210 in an on position, while actuator plate 230 is in an off position. Thus, main circuit breaker 20 is switched on while the backup circuit breaker 30 is switched off. In this position, the engagement of the actuator pins 262 and 258 in slots 244 and 242 respectively prevent the actuator plate 230 from moving from the off position. Thus, the actuator assembly 200 provides a mechanical interlock preventing circuit breaker 30 from being switched on while circuit breaker 20 is on. To switch from the commercial power supply to the local generator, the rotary actuator 250 is rotated counterclockwise from the starting position shown in FIG. 7 to the ending position shown in FIG. 11.

Figure 8:
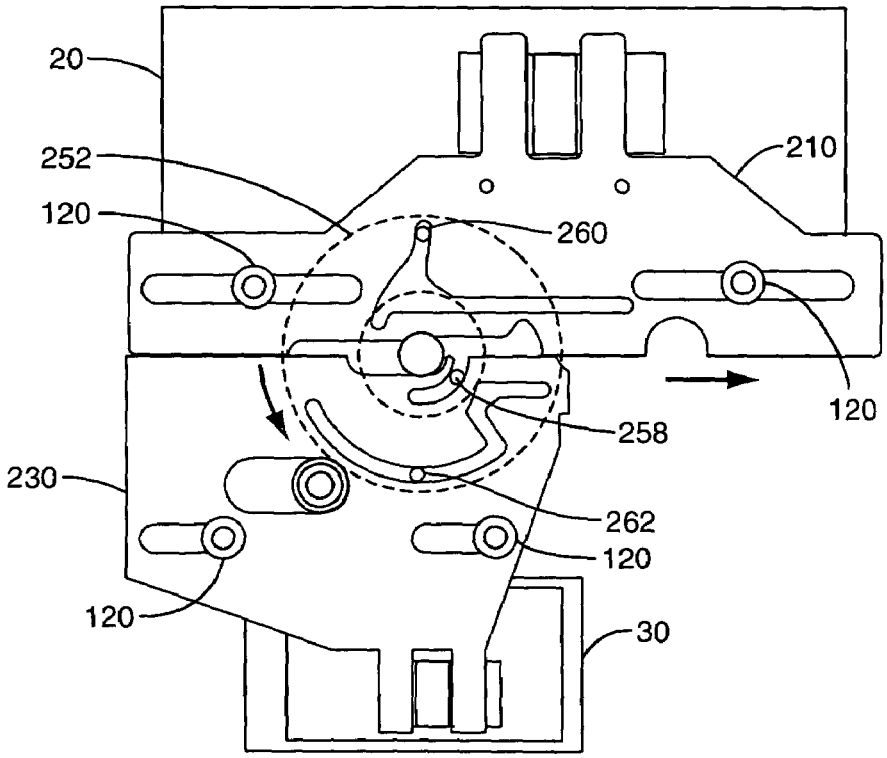
FIG. 8 is a top view of switching mechanism showing the main circuit breaker in the middle of its travel towards the off position and the backup circuit breaker in the off position.

In FIG. 8 the main circuit breaker is in the middle of its travel to the off position and the backup circuit breaker is in the off position. Actuator pin 260 on the rotary actuator 250 has moved up into a drive portion 224*b* of the slot 224. The actuator pin 260 applies force against the sidewall of the slot 224 as the actuator 250 turns to move the actuator plate 210 to the left. Actuator pin 262 is traveling through a clearance portion 244*a* of slot 244 that allows free movement of the actuator 250 while actuator plate 230 remains stationary. Actuator pin 258 is engaged in slot 242 to prevent movement of actuator plate 230. The main circuit breaker 20 is in the middle of its travel to the off position, while the backup circuit breaker 30 remains in the off position. Thus, the switching mechanism 10 provides a mechanical interlock preventing circuit breaker 30 from being switched on while circuit breaker 20 is on.

Figure 9:
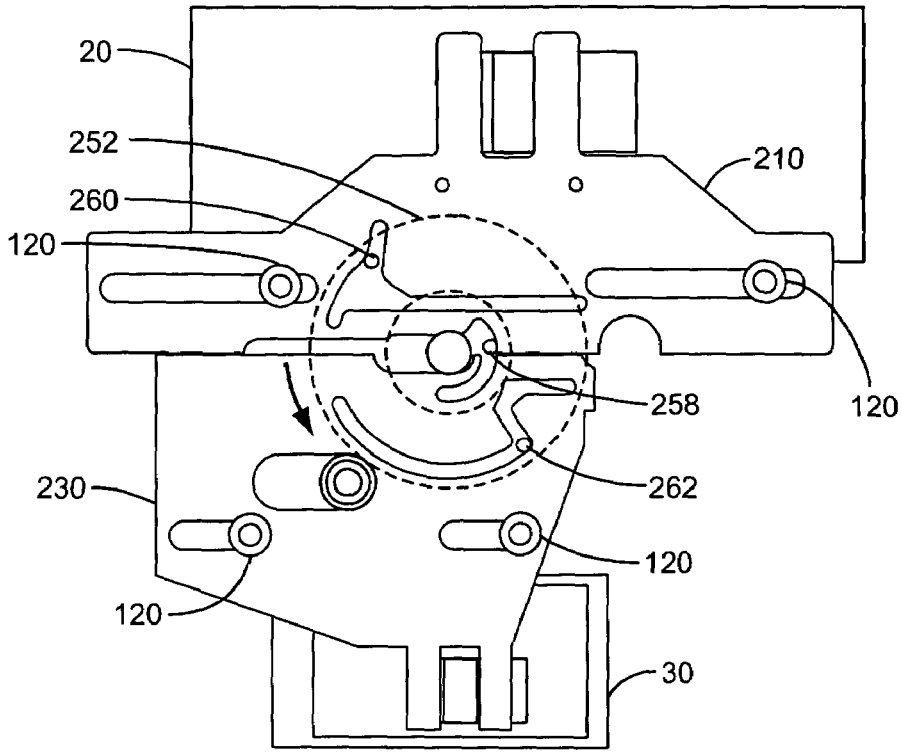
FIG. 9 is a top view showing the switching mechanism in the middle of a switching cycle with both circuit breakers in an off position.

In FIG. 9, the actuator plate 210 has moved the main circuit breaker 20 to the off position. Actuator pin 260 on the actuator 250 is now moving into the clearance portion 224*a* of slot 224. Actuator pin 258 has moved out of slot 242 so that actuator plate 230 can now move to the right. Actuator plate 210 will remain stationary while the actuator 250 turns because the actuator pin 260 is in the clearance portion 224*a* of slot 224. Actuator pin 262 is moving into the drive portion 244*b* of slot 244. At this point, any further counterclockwise rotation of the actuator 250 will move actuator plate 230 to the right.

Figure 10:
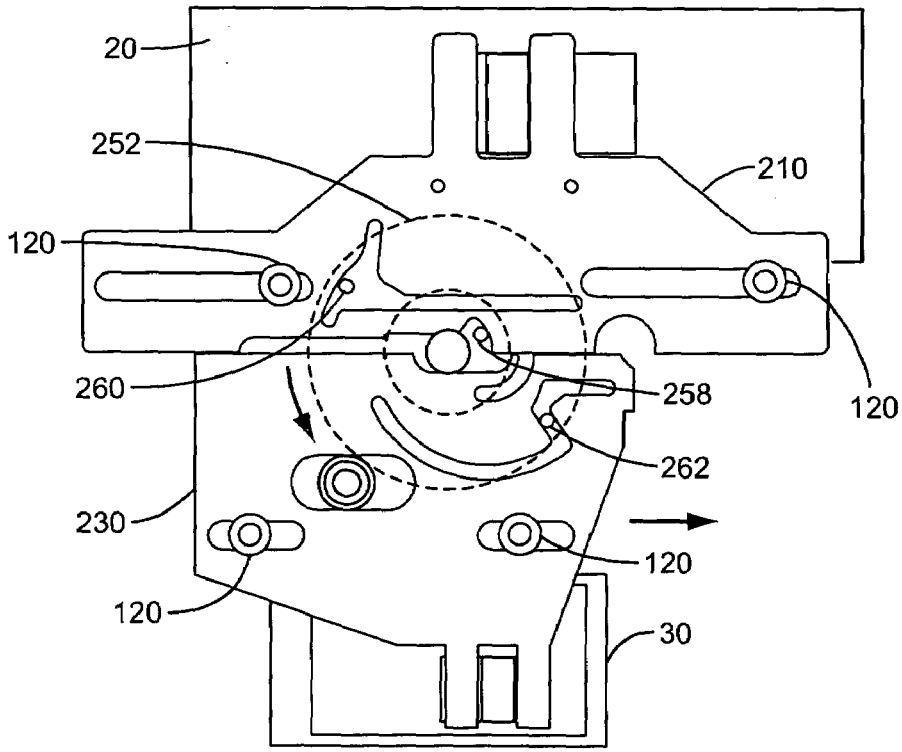
FIG. 10 is a top view of switching mechanism showing the main circuit breaker in the off position and the backup circuit breaker beginning its travel to the on position.

In FIG. 10, the main circuit breaker 20 is off and the backup circuit breaker 30 is in the middle of its travel to the on position. The actuator pin 260 is moving downward in the clearance portion 224*a* of slot 224 so that actuator plate 210 is stationary. Actuator pin 262 is pushing against the sidewall of the slot 244 to move the actuator plate 230 to the right. Actuator pin 258 is moving upward in slot 222.

Figure 11:
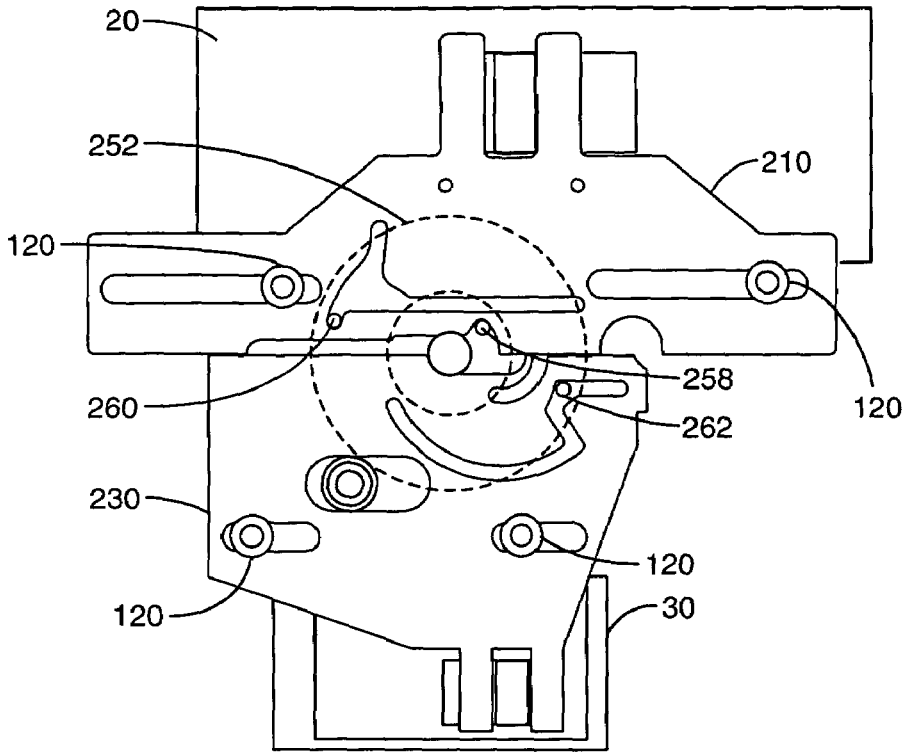
FIG. 11 is a top view of switching mechanism at the end of the switching cycle showing the main circuit breaker in the off position and the backup circuit breaker in the on position.

In FIG. 11, the main circuit breaker 20 is in the off position and the backup circuit breaker 30 is in the on position. Actuator pin 260 prevents the actuator plate 210 from being moved to the right while the actuator plate 230 is in the on position. Thus, the actuator assembly provides a mechanical interlock preventing circuit breaker 20 from being switched on while circuit breaker 30 is on.

When switching in the opposite direction, the actuator rotates in a clockwise direction and the process described above is reversed. Actuator plate 230 is initially moved to the off position by the actuator pin 262. Once the actuator plate 230 is in the off position, actuator pin 260 moves actuator plate 210 to the on position. The mechanical interlocks function the same in both directions.

Figure 12:
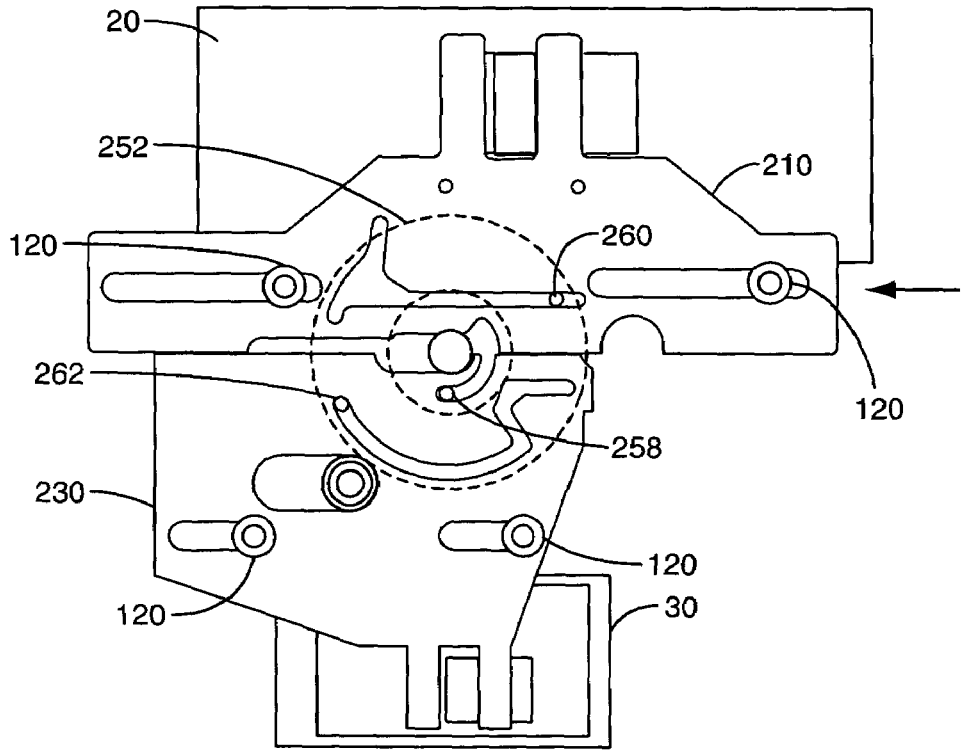
FIG. 12 is a top view of switching mechanism showing the main circuit breaker moved manually to an off position while the backup circuit breaker is in the off position.
Figure 13:
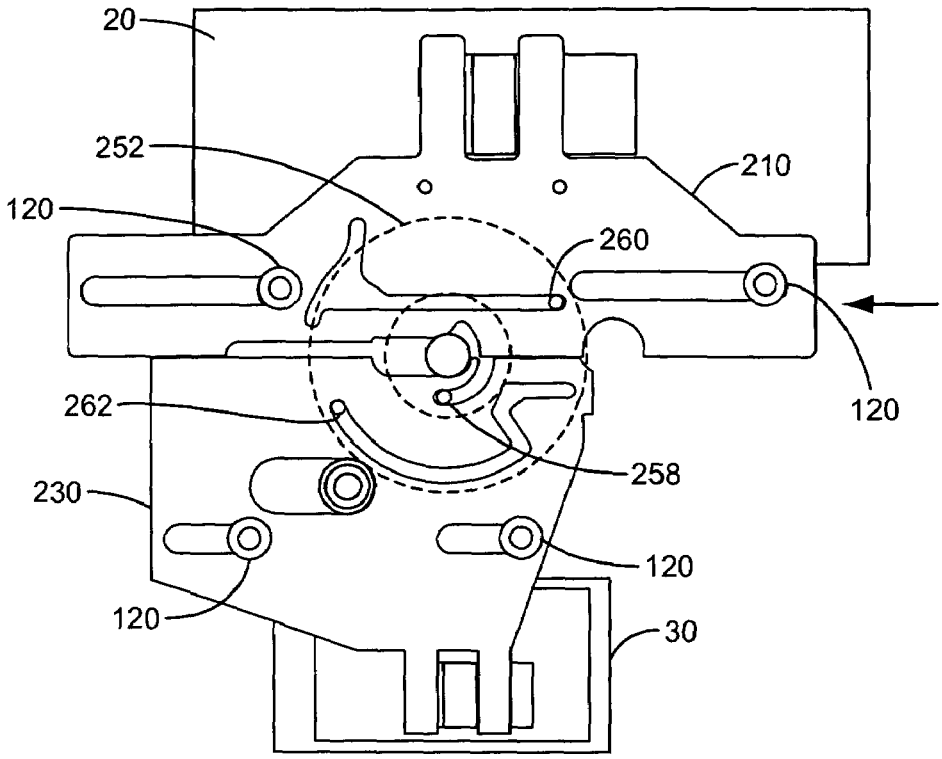
FIG. 13 is a top view of switching mechanism showing the main circuit breaker moved manually to a reset position while the backup circuit breaker is in the off position.
Figure 14:
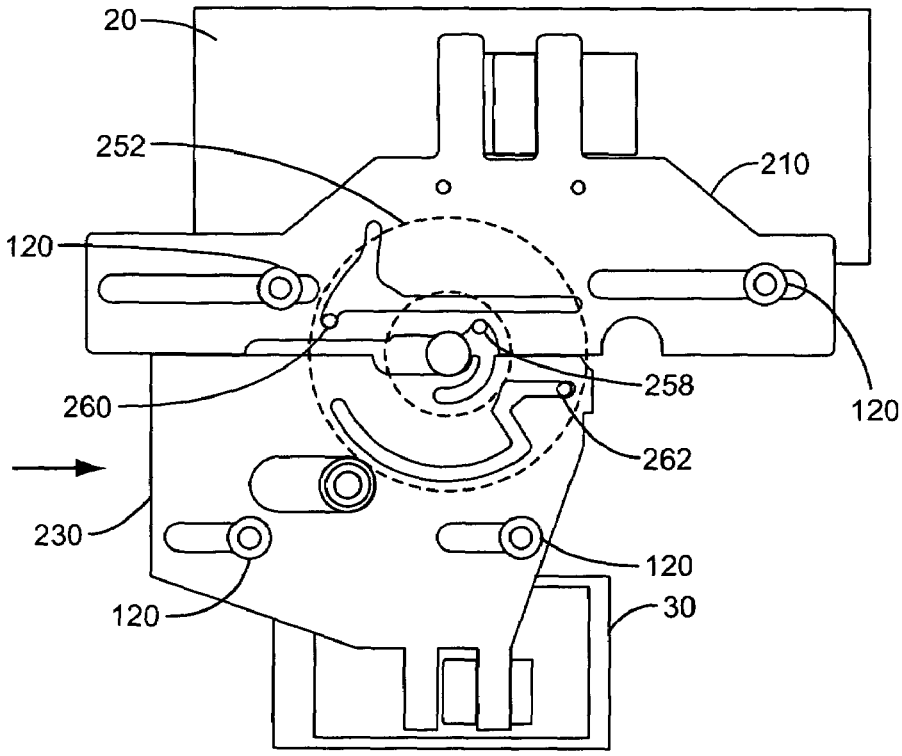
FIG. 14 is a top view of the switching mechanism showing the backup circuit breaker manually moved to the off position while the main circuit breaker is in the off position.

FIGS. 12–14 illustrate a manual override feature of the switching mechanism 10. In FIG. 12, the main circuit breaker 20 has been manually switched off while the backup circuit breaker 30 is in the off position. Note that a slot extension 224*c* of slot 224 allows movement of the actuator plate 210 to an off position when the actuator plate 230 is also in the off position. It should also be noted that the engagement of the actuator pins 260 in the slot extension 224*c* of slot 224 prevents operation of the actuator 250 until the actuator plate 210 is returned to the on position. Thus, when the main circuit breaker 20 is manually switched off, the main circuit breaker 20 must be manually returned to the on position before the actuator 250 will be operative. FIG. 13 illustrates movement of the actuator plate 210 to a reset position, which is left of the off position.

A manual override feature is also provided for the backup circuit breaker 30 as shown in FIG. 14. FIG. 14 shows that the actuator plate 230 moved manually from an on position to an off position while the actuator plate 210 is also in the off position. Note that a slot extension 244*c* of slot 244 allows movement of the actuator plate 230 to an off position when the actuator plate 210 is also in the off position. The engagement of actuator pin in the slot extension 244*c* of slot 244 prevents operation of the actuator 250 until the backup circuit breaker 30 is returned to the on position. The slot extension 244*c* also allows movement of the circuit breaker 30 to the reset position.

Slot extensions 224*c* and 244*c* also allow the circuit breakers 20 and 30 respectively to move toward the off responsive to an overload condition, i.e., when the circuit breakers 20 and 30 are tripped by excessive current. When the circuit breakers 20 and 30 are tripped, the engagement of actuator pins 260 and 262 in the slot extensions 224*c* and 244*c* prevent operation of the actuator 250 as previously described until the tripped circuit breaker 20 or 30 is returned to the on position. In this case, the user manually moves the tripped breaker 20 or 30 to the reset position and then back to the on position to reset the breaker.

Figure 16:
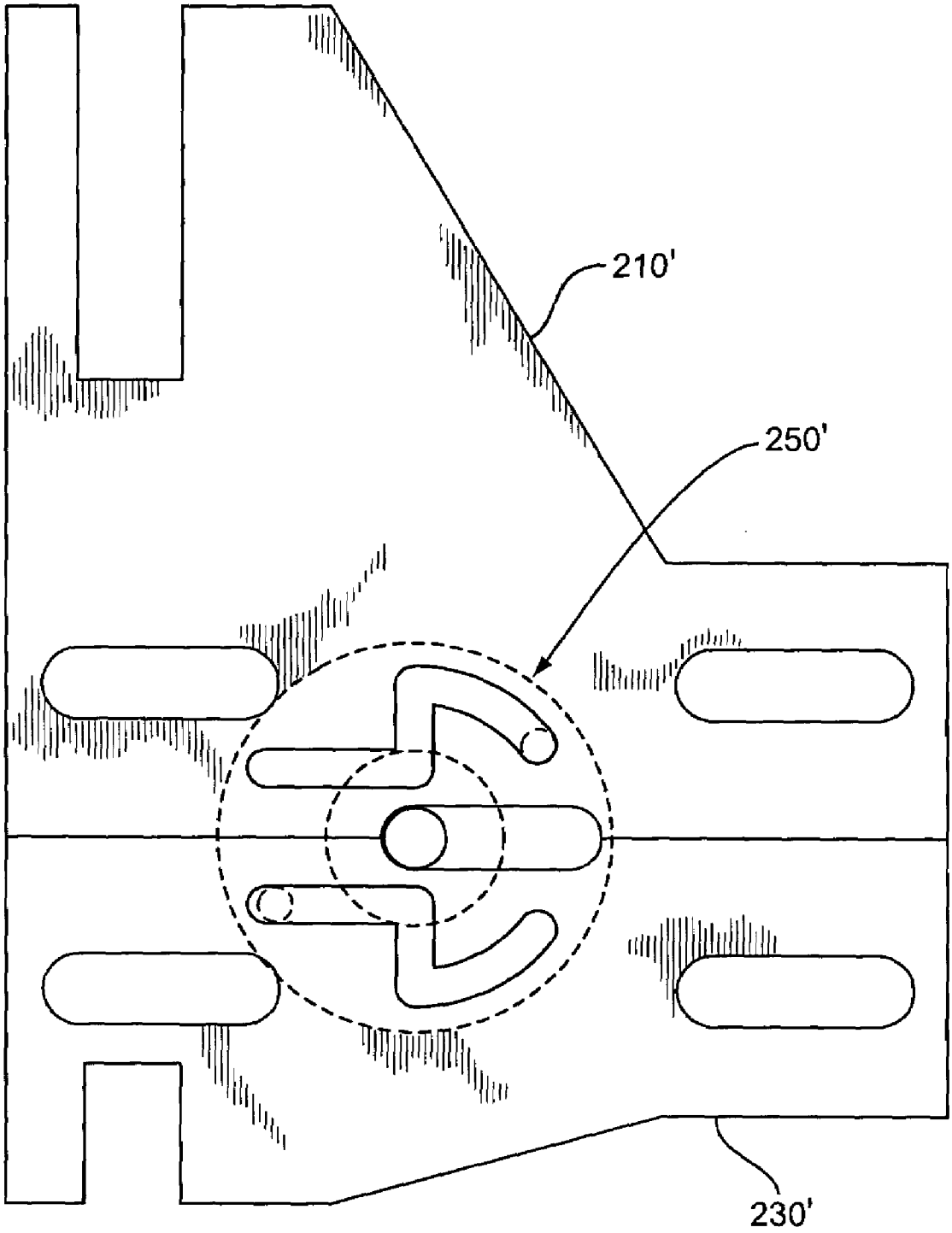
FIG. 16 is a top view of two actuator plates for an alternate embodiment of the switching mechanism.

FIG. 16 illustrates an alternate configuration of the actuator plates 210 and 230 that can be used when operating identical circuit breakers in a symmetrical arrangement. The actuator plates 210' and 230' operate in the same manner as previously described.

The switching mechanism 10 experiences some mechanical shock during operation. The mechanical shock is created by the action of internal parts of the circuit breakers 20 and 30. In the case of large circuit breakers, the mechanical shock can be severe enough to require strengthening of the switching mechanism 10. This would lead to larger parts and increased costs. The present invention avoids this problem by providing a shock absorber 400 to absorb the mechanical shock created by actuation of the main circuit breaker 20. A shock absorber 400 could also be used for the backup circuit breaker 30.

Figure 17:
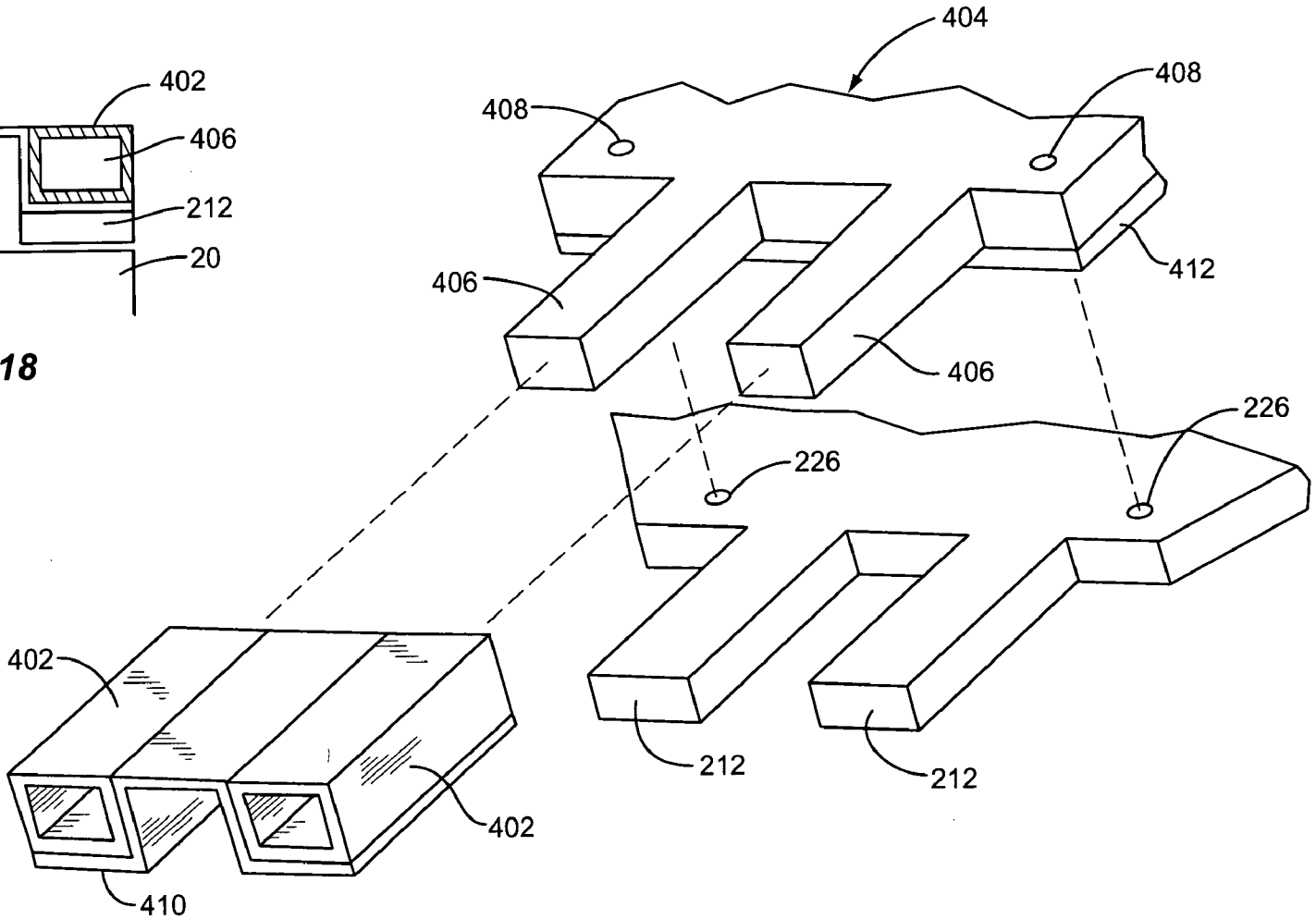
FIG. 17 is an exploded perspective view of a shock absorber for the switching mechanism.
Figure 18:
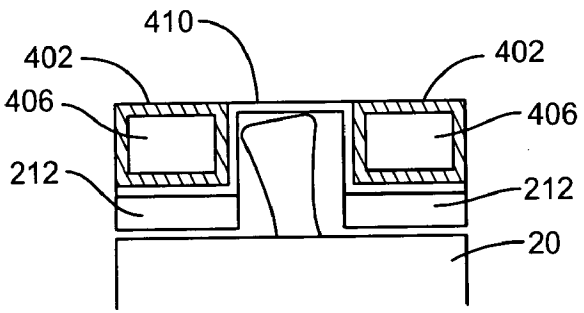
FIG. 18 is an end view of the shock absorber mounted to the switching mechanism.

An exemplary embodiment of the shock absorber 400 is shown in FIGS. 17 and 18. The shock absorber 400 comprises two shock absorbing bushings 402 made of a soft latex rubber, or equivalent material capable of absorbing a mechanical shock, that slide over respective fingers 406 of an adapter plate 404. The adapter plate 404 is mounted on the actuator plate 210 and held in place by screws (not shown). The adapter plate 404 includes screw holes 408 which align with corresponding screw holes 226 on the actuator plate 210. A spacer 412 spaces the fingers 406 of the adapter plate 404 above the fingers 212 of the actuator plate 210 to accommodate the shock absorbing bushings 402. The spacing between the fingers 212 and 412 can be slightly less than the thickness of the busing 402 so that the bushing 402 is slightly compressed. A bracket 410 is sandwiched between the bushings 402 and the fingers 212 of the actuator plate 210 as best seen in FIG. 18. The bushings 402 absorb the energy of shock produced by the circuit breaker 20. Because the bushings 402 are made of a soft latex rubber, they would wear too fast if engaged directly by the toggle 22 of the circuit breaker 20. Bracket 410 is interposed between the bushings 402 and the toggle 22 to prevent wear of the bushings 402. In an alternate embodiment of the invention, the bushings 402 can be installed directly on the fingers 212 of the actuator plate 210. While the present invention employs a cushion type shock absorber, other types of shock absorbers could also be used. For example, a spring-type shock absorber 400 could be used.

The invention claimed is:

1. A switching mechanism comprising:

a first actuator plate to operate a first circuit breaker connected to a primary power supply, the first actuator plate movable between on and off positions;

a second actuator plate to operate a second circuit breaker connected to a secondary power supply, the second actuator plate movable independently of the first actuator plate between on and off positions;

an actuator movable between first and second positions, the actuator being operatively connected to the first and second actuator plates so that the actuator moves the first actuator plate to an on position and the second actuator plate to an off position when the actuator is moved to the first position, and moves the first actuator plate to an off position and the second actuator plate to an on position when the actuator is moved to the second position;

a motor to drive the actuator; and at least one shock absorber to absorb shock due to switching of one of the first and second circuit breakers to prevent damage to said switching mechanism and said switched circuit breaker wherein the shock absorber is a compressible bushing interposed between a toggle of the circuit breaker and one of the actuator plates.

2. The switching mechanism of claim 1 further comprising a shield disposed between said bushing and said toggle to prevent wear of said bushing and to damp possible oscillation.

3. The switching mechanism of claim 2 wherein said shock absorber comprises a pair of compressible bushings.

4. The switching mechanism of claim 3 wherein said shield interconnects said pair of bushings.

5. The switching mechanism of claim 3 wherein said pair of bushings are tubular in form and are mounted over a pair of fingers.

6. The switching mechanism of claim 5 wherein said pair of fingers are integral with one of said actuator plates.

7. The switching mechanism of claim 5 further comprising an adapter plate and wherein said pair of fingers are integral with said adapter plate.

8. A switching mechanism comprising:

an actuating mechanism to sequentially actuate a pair of circuit breakers;

a motor to drive said actuating mechanism; and a shock absorber to absorb shock due to switching of one of the first and second circuit breakers to prevent damage to said motor wherein the shock absorber is a compressible bushing interposed between a toggle of the circuit breaker and a component of the actuating mechanism.

9. The switching mechanism of claim 8 further comprising a shield disposed between said bushing and said toggle to prevent wear of said bushing.

10. The switching mechanism of claim 8 wherein the actuating mechanism includes at least one finger to manipulate said toggle of said circuit breaker and wherein said shock absorber is mounted on said finger.

11. The switching mechanism of claim 10 wherein said bushing is adapted to slide over said finger of said actuator.

12. The switching mechanism of claim 10 wherein said bushing mounts on top of said finger of said actuator.

13. The switching mechanism of claim 10 wherein the actuating mechanism includes at least two fingers and two bushings mounted to respective fingers.

* * * * *